US006680698B2

(12) United States Patent
Eiges

(10) Patent No.: US 6,680,698 B2
(45) Date of Patent: Jan. 20, 2004

(54) PLANAR RAY IMAGING STEERED BEAM ARRAY (PRISBA) ANTENNA

(75) Inventor: Ron Eiges, Haifa (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/139,279

(22) Filed: May 7, 2002

(65) Prior Publication Data

US 2002/0171585 A1 Nov. 21, 2002

(30) Foreign Application Priority Data

May 7, 2001 (IL) ..... 143006

(51) Int. Cl.[7] ..... H01Q 3/26; H01Q 21/06

(52) U.S. Cl. ..... 342/373; 342/361

(58) Field of Search ..... 342/373, 361, 342/368–372, 374, 84; 373/754, 909–911 L

(56) References Cited

U.S. PATENT DOCUMENTS

| | | | | | |
|---|---|---|---|---|---|
| 2,921,308 | A | * | 1/1960 | Hansen et al. | 343/754 |
| 3,255,454 | A | * | 6/1966 | Walter et al. | 343/754 |
| 3,386,099 | A | * | 5/1968 | Walter et al. | 343/754 |
| 3,510,876 | A | * | 5/1970 | Green | 342/368 |
| 3,656,165 | A | * | 4/1972 | Walter et al. | 343/754 |
| 4,728,805 | A | * | 3/1988 | Dempsey | 342/374 |
| 4,819,000 | A | * | 4/1989 | Meyer | 342/374 |
| 6,104,343 | A | * | 8/2000 | Brookner et al. | 342/373 |

OTHER PUBLICATIONS

An optically controlled MMW beam–steering antenna based on a novel architecture, Manasson, V.A.; Sadovnik, L.S.; Yepishin, V.A.; Marker, D., Microwave Theory and Techniques, IEEE Transactions on , vol.: 45 Issue: 8, p. 1497–1500, Aug. 1997.*

DBS–2400 In flight TV Antenna System Product Information Sheet, Datron/Tranasco Inc 200 West Los Angeles Ave, Simi Valley CA 93065.

Butler et al: "Beam forming matrix simplifies design of electronically scanned antennas" Electronic Design vol.. 9 pp 170–173 Apr. 1961 (BUT61).

(List continued on next page.)

*Primary Examiner*—Thomas H. Tarcza
*Assistant Examiner*—F H Mull
(74) *Attorney, Agent, or Firm*—Mark M. Friedman

(57) ABSTRACT

A planar, ray-imaging, electronically steered array antenna, whose radiating array elements are disposed on a planar surface above an electrically conductive ground plane that enhances the antenna gain. The conductive ground plane forms an integral part of the antenna, and the required dimensions of this ground plane depend on the array height, and on the lowest elevation coverage angle from the (possibly tilted) ground plane. The antenna is further characterized by a modular design that tailors the required antenna gain and azimuthal directivity through the stacking of identical antenna segments side by side. The antenna can generate, with the aid of a multiple-beam microwave network or a two-ended series-feed network, a pair of symmetrically steered beams from an incident wavefront received by a linear (column) or planar array, in conjunction with reflections from a bottom metal plate. The coherent combination of the pair of symmetrically steered beams with the reflections allows an effective doubling of the antenna aperture in elevation.

37 Claims, 9 Drawing Sheets

OTHER PUBLICATIONS

Ruze J "Wide–angle metal–plate optics" Proceedings of IRE Vol 38 pp53–58 Jan. 1950.
Rotman et al "Wide–angle lens for line source applications" IEEE Transactions on Antennas and Propagation Vol AP–11, pp 623–632 Nov. 1963.
Hansen RC "Microwave scanning antennas" Vol 111 Academic Press NY 1966, Chapter 2.
"Novel Ferroelectric materials for phased array antennas", IEEE Transactions on Ultrasonics, Ferroelectrics and Frequency Control. Vol 44, No. 4, Jul. 1997, pp. 792–797.
Cherepanov A.S. et al: "Innovative integrated ferrite phased array technologies for EHF radar communication applications" IEEE International Symposium on Phased Array Systems and Technology, 1996 pp. 74–77.

* cited by examiner

PLANAR RAY IMAGING STEERED BEAM ARRAY (PRISBA) ANTENNA

CROSS REFERENCE TO RELATED APPLICATIONS

The present application claims the benefit of priority from Israel Patent Application No. 143006 filed May 7, 2001, the contents of which are incorporated herein by reference.

FIELD AND BACKGROUND OF THE INVENTION

The present invention relates to antennas, specifically electronically steered planar array antennas. More specifically, the present invention relates to antennas that can, in the presence of a large electrically conductive plate, provide undegraded beam steering at any desired polarization, in planes perpendicular to, and at low elevation angles above the conductive plate.

One example is a Luneberg hemispherical lens antenna mounted on top of a metal-plane plate, as shown for example in C. H. Walter et al. 'Surface wave Luneberg lens antenna', U.S. Pat. No. 3,255,454 and in "DBS-2400 In-Flight TV Antenna System", Product Information Sheet, Datron/Transco Inc., 200 West Los Angeles Avenue, Simi Valley, Calif. 93065 (hereinafter DBS2400). This antenna arrays 4 Luneberg hemispherical lenses for higher antenna gain, which is further enhanced by virtue of reflections from the ground plane. The DBS2400 antenna provides electronic polarization setting (via control of feed element polarization) and mechanical beam steering in azimuth (rotation of metal-plane plate) and in elevation (movement of feed elements in elevation around the hemispherical lenses).

Electronic beam steering may be applied to a Luneberg hemispherical lens antenna unit, but this requires the incorporation of a switch network that selects one or a group of adjacent feed elements from a concave spherical feed array that covers a partial sector of the hemispherical Luneberg lens. In addition, when an array of lenses is used for gain enhancement (DBS-2400), electronic beam steering in azimuth will be limited by gain degradation due to mutual lens blockage.

A second example for a steered beam gain enhanced antenna lying on top of an electrically conductive ground plane is the Cylindrical Ray Imaging Steered Beam Array (CRISBA) antenna described in co-pending published U.S. patent application No. 2002/0163480 by the present inventor. The antenna described therein features modularly tailored directive gain, and lends itself to electronic beam steering in azimuth and in elevation, and in addition allows electronically controlled polarization setting. However, the cylindrical geometry of the CRISBA antenna trades antenna gain performance at low elevation angles above the ground plane for better gain performance at higher elevation angles. If wider elevation coverage is not essential, an antenna of planar geometry of the same height above the ground plane should provide higher gain.

Thus, very few prior art antennas in general, and no planar array antennas in particular, can provide undegraded beam steering at any desired polarization, in planes perpendicular to, and at low elevation angles above the conductive plate are of planar array geometry.

It would therefore be beneficial to have a low-profile, cost-effective polarization-controlled, steered-beam antenna of planar geometry that achieves modularly tailored high directive gain at low elevation angles above a large electrically conductive ground plane on top of which it is mounted.

SUMMARY OF THE INVENTION

The present invention discloses an innovative planar, ray-imaging, electronically-steered array antenna, whose radiating array elements are disposed on a planar surface sector above an electrically conductive ground plane that enhances the antenna gain. The antenna of this invention is to be mounted over, and perpendicular to, a large metal ground plane, and provide high directive gain at low elevation angles above the ground plane. The conductive ground plane forms an integral part of the antenna, and the required dimensions of this ground plane depend on the array height, and on the lowest elevation coverage angle from the possibly tilted) ground plane. The antenna of the present invention is further characterized by a modular design that tailors the required antenna gain and azimuthal directivity through the stacking of identical antenna segments side by side. The antenna of the present invention is unique in that it can generate, with the aid of a multiple-beam microwave network or a two-ended series-feed network, a pair of symmetrically steered beams from an incident wavefront received by a linear (column) or planar array, in conjunction with reflections from a bottom metal plate. The coherent combination of the pair of symmetrically steered beams with the reflections allows an effective doubling of the antenna aperture in elevation.

According to the present invention there is provided, in a first preferred embodiment, a ray-imaging, electronic beam-steering antenna comprising at least one antenna segment, each antenna segment having at least one output and including a plurality of horizontally-polarized radiating column-array elements and an elevation beam-forming assembly, the plurality of radiating column-array elements disposed adjacently perpendicular to an electrically conductive ground reflector plane, the ground reflector plane allowing gain-enhanced, horizontal-polarization beam generation and steering in planes perpendicular to the ground reflector plane, whereby the antenna is electronically steerable in elevation, or both in elevation and in azimuth.

According to one feature of the first preferred embodiment of the antenna of the present invention, the elevation beam-forming assembly includes a microwave multiple-beam network having a first plurality of element ports and a second plurality of beam ports, a set of two-way power dividers, each of the set having a pair of output ports and incorporating an 180° phase shift between two ports of the pair of output ports, and a set of two-way power combiners, each of the set having a pair of input ports and incorporating an 180° phase shift between two ports of the pair of input ports, and a beam selection switching module connected to the set of power combiners.

According to another feature of the first preferred embodiment of the antenna of the present invention, the microwave multiple-beam network is a Butler type matrix.

According to yet another feature of the first preferred embodiment of the antenna of the present invention, the Butler type matrix is selected from the group consisting of stripline printed circuits and microstrip printed circuits microwave matrices.

According to another feature of the first preferred embodiment of the antenna of the present invention, the microwave multiple-beam network is a Ruze-type or Rotman-type lens.

According to yet another feature of the first preferred embodiment of the antenna of the present invention, the beam selector switching module includes a single-pole switching module that incorporates a passive beam conversion matrix.

According to yet another feature of the first preferred embodiment of the antenna of the present invention, the beam selection switching module includes a two-pole switch module, whereby the two-pole switch module allows both single pole selection and dual pole selection.

According to the present invention, the first preferred embodiment of the antenna of the present invention further comprises a power combiner connected electrically to the outputs of at least two antenna segments, and selected from the group consisting of a conventional power combiner, a power combiner having phase shifters, a power combiner having delay phase shifters, a Ruze-type lens, a Rotman-type lens, and any combination thereof.

According to another version of the first preferred embodiment of the antenna of the present invention, the elevation beam-forming assembly includes a double ended series feed network or a double ended leaky wave structure and a two-way power combiner that incorporates a 180° phase shift at one of its input ports.

According to the present invention, there is provided, in a second preferred embodiment, a ray-imaging, electronic beam-steering antenna comprising at least one antenna segment, each antenna segment having at least one output and including a plurality of vertically-polarized radiating column-array elements and an elevation beam-forming assembly, the plurality of radiating column-array elements disposed adjacently perpendicular to an electrically conductive ground reflector plane, the ground reflector plane allowing gain-enhanced, vertical-polarization beam generation and steering in planes perpendicular to the ground reflector plane, whereby the antenna is electronically steerable in elevation, or both in elevation and in azimuth.

According to one feature of the second preferred embodiment of the antenna of the present invention, the elevation beam-forming assembly includes a microwave multiple-beam network having a first plurality of element ports and a second plurality of beam ports, a set of two-way power dividers, each of the set of power dividers having a pair of output ports, a set of two-way power combiners, each of said set of power combiners having a pair of input ports, and a beam selection switching module connected to the set of power combiners.

According to another feature of the second preferred embodiment of the antenna of the present invention, the microwave multiple-beam network is a Butler type matrix.

According to yet another feature of the second preferred embodiment of the antenna of the present invention, the Butler type matrix is selected from the group consisting of stripline printed circuits and microstrip printed circuits microwave matrices.

According to another feature of the second preferred embodiment of the antenna of the present invention, the microwave multiple-beam network is a Ruze-type or Rotman-type lens.

According to yet another feature of the second preferred embodiment of the antenna of the present invention, the beam selector switching module includes a single-pole switching module that incorporates a passive beam conversion matrix.

According to yet another feature of the second preferred embodiment of the antenna of the present invention, the beam selection switching module includes a two-pole switch module, whereby the two-pole switch module allows both single pole selection and dual pole selection.

According to the present invention, the second preferred embodiment of the antenna of the present invention further comprises a power combiner connected electrically to the outputs of at least two antenna segments, and selected from the group consisting of a conventional power combiner, a power combiner having phase shifters, a power combiner having delay phase shifters, a Ruze-type lens, a Rotman-type lens, and any combination thereof.

According to another version of the second preferred embodiment of the antenna of the present invention, the elevation beam-forming assembly includes a double ended series feed network or a double ended leaky wave structure and a two-way power combiner.

According to the present invention there is provided, in a third preferred embodiment, a ray-imaging, electronic beam-steering antenna comprising at least one antenna segment, each antenna segment having at least one output and including a plurality of dual-polarized radiating column-array elements and an elevation beam-forming assembly, the plurality of radiating column-array elements disposed adjacently perpendicular to an electrically conductive ground reflector plane, the ground reflector plane allowing, for any polarization, gain-enhanced, beam generation and steering in planes perpendicular to the ground reflector plane, whereby the antenna is electronically steerable in elevation, or both in elevation and in azimuth.

According to one feature of the third preferred embodiment of the antenna of the present invention, the elevation beam-forming assembly includes a microwave multiple-beam network, a set of 0°/180° hybrid couplers that symmetrically feed the element ports and beam ports of the multiple-beam matrix, and a pair of beam selection switching modules connected respectively to "sum" and "difference" ports of the sub-set of 0°/180° hybrid couplers that feed the beam ports of the multiple-beam network.

According to another feature of the third preferred embodiment of the antenna of the present invention, the elevation beam-forming assembly further includes a complex weighting module connected to the pair of beam selector switching modules.

According to another feature of the third preferred embodiment of the antenna of the present invention, the microwave multiple-beam network is a Butler type matrix.

According to yet another feature of the third preferred embodiment of the antenna of the present invention, the Butler type matrix is selected from the group consisting of stripline printed circuits and microstrip printed circuits microwave matrices.

According to another feature of the third preferred embodiment of the antenna of the present invention, the microwave multiple-beam network is a Ruze-type or Rotman-type lens.

According to the present invention, the third preferred embodiment of the antenna of the present invention further comprises at least one power combiner connected electrically to the outputs of least two antenna segments, the power combiner selected from the group consisting of a conventional power combiner, a power combiner having phase shifters, a power combiner having delay phase shifters, a Ruze-type lens, a Rotman-type lens, and any combination thereof.

According to yet another feature of the third preferred embodiment of the antenna of the present invention, each of the pair of beam selector switching modules includes a single-pole switching module that incorporates a passive beam conversion matrix.

According to yet another feature of the third preferred embodiment of the antenna of the present invention, each of the pair of beam selector switching modules includes a two-pole switch module, whereby the two-pole switch module allows both single pole selection and dual pole selection.

According to another version of the third preferred embodiment of the antenna of the present invention, the elevation beam-forming assembly includes a pair of feed networks having a plurality of output ports, and a complex weight module, connected to the output ports of the pair of feed networks.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention refers to a planar ray imaging, beam steered, and polarization controlled array antenna that is configured to operate in the presence of a large ground plane. The ground plane lies perpendicular to the array plane, and enhances its directive gain. In contrast with all prior art planar array scanning antennas, which are characterized by degraded directive gain at low elevation angles above an electrically conductive ground plane, the presence of the ground plane in juxtaposition to the antenna of the present invention, effectively increases the antenna aperture for a given constrained elevation profile above the ground plane, and consequently enhances its directive gain at low elevation angles.

The antenna of the present invention may include one or several antenna sub-units, wherein each antenna sub-unit covers a specified angular sector, providing electronic beam steering in two dimensions: elevation and azimuth. At least three antenna sub-units would be required for full 360° electronically steered coverage in azimuth. The principles and operation of the antenna of the present invention may be better understood with reference to the drawings and the accompanying description.

The ground-plane gain-enhanced elevation beam-steering feature of this invention is preferably implemented using multiple-beam microwave networks with symmetrically excited phase gradients along its element ports and co-phased beam port outputs, in conjunction with a set of 0°/180° hybrid couplers. The multiple-beam networks are implementable as half-integer phase moded beam-cophased Butler matrices as described in Butler, J. and Lowe, R.: 'Beam forming matrix simplifies design of electronically scanned antennas', Electronic Design, Vol. 9, pp. 170–173, April 1961 (hereinafter BUT61). Alternatively, multiple-beam networks may be implemented as beam symmetric and co-phased Ruze microwave lenses as in Ruze, J.: 'Wide-angle metal-plate optics', Proceedings of IRE, Vol. 38, pp. 53–58, January 1950 (hereinafter RUZ50), or symmetric and co-phased Rotman microwave lenses as in Rotman, W. and Turner, R. F.: 'Wide-angle lens for line source applications', IEEE Transactions on Antennas and Propagation, Vol. AP-11, pp. 623–632, November 1963 (hereinafter ROT63).

In one preferred embodiment, azimuth beam forming simply involves the linearly stacked combination of identical antenna segments that form an antenna sub-unit. Alternatively, if frequency insensitive electronic beam steering in azimuth is of essence, a Ruze type microwave lens (RUZ50) or a Rotman type microwave lens (ROT63), in conjunction with an RF switch could replace an otherwise simple azimuth power combiner.

Figure 1:
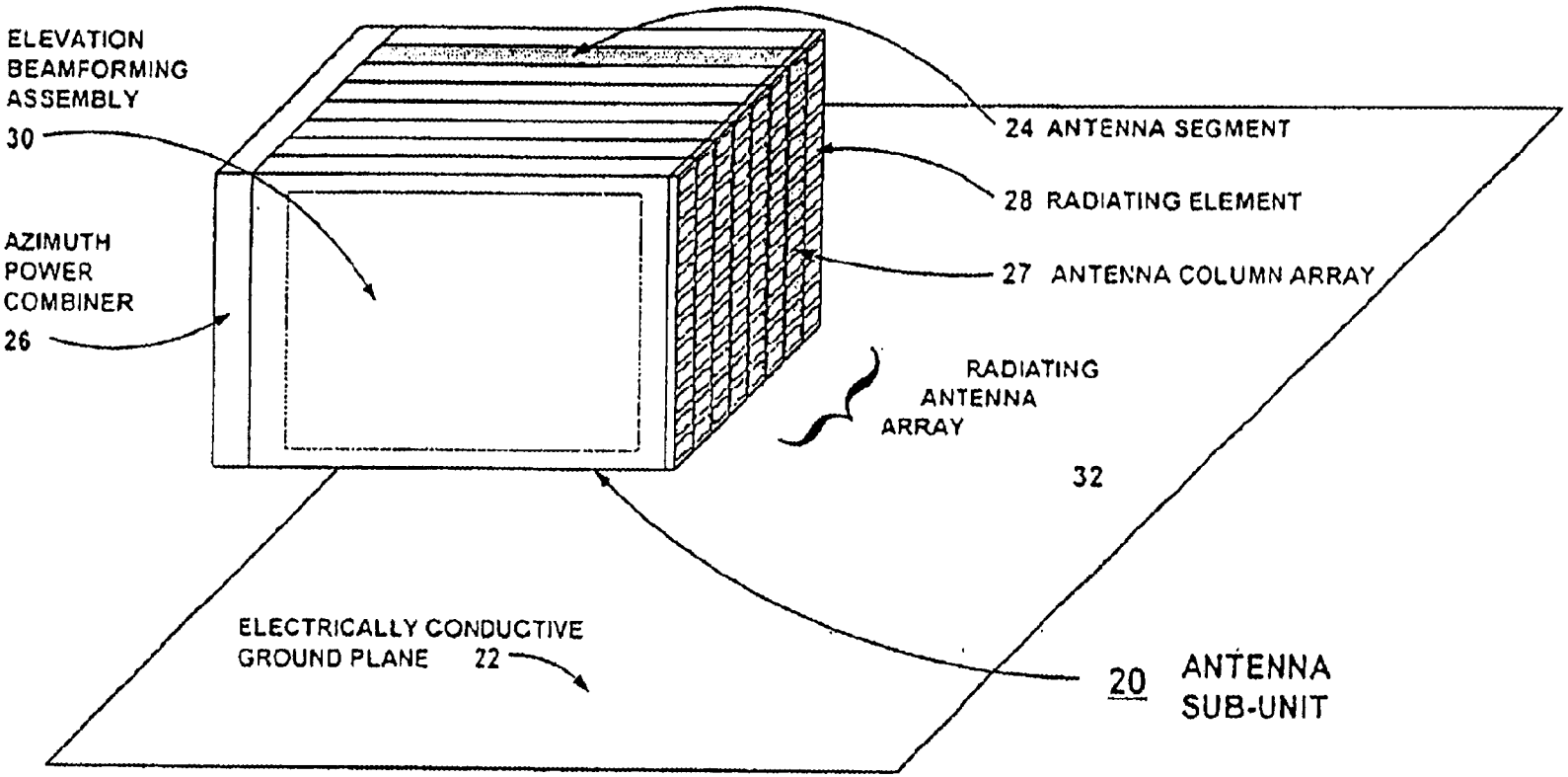
FIG. 1 is a schematic diagram describing an antenna sub-unit as an array of stacked antenna segments mounted on an extended conductive ground plane.

FIG. 1 schematically depicts a preferred embodiment of an antenna sub-unit 20 lying on an extended electrically conductive ground plane 22. We assume, without loss of generality, that ground plane 22 coincides with the azimuth (zero-elevation) plane. Antenna sub-unit 20 typically includes a plurality of linearly arrayed antenna segments 24, disposed adjacently and lying perpendicular to ground plane 22, as well as an azimuth power combiner/divider 26. The stacking together of identical antenna segments 24 allows the modular tailoring of the antenna dimensions parallel to the conductive ground plane to the required directive gain. Each antenna segment 24 includes a linear column array 27 of vertically and horizontally-fed radiating elements 28, and an elevation beam-forming assembly 30. Radiating elements 28 of all linear column arrays 27 form together a planar radiating array 32, perpendicular to ground plane 22. The radiating elements may be implemented as dual-polarized antenna radiators with low cross-feed coupling, or as pairs of linearly polarized antenna radiators.

Figure 2:
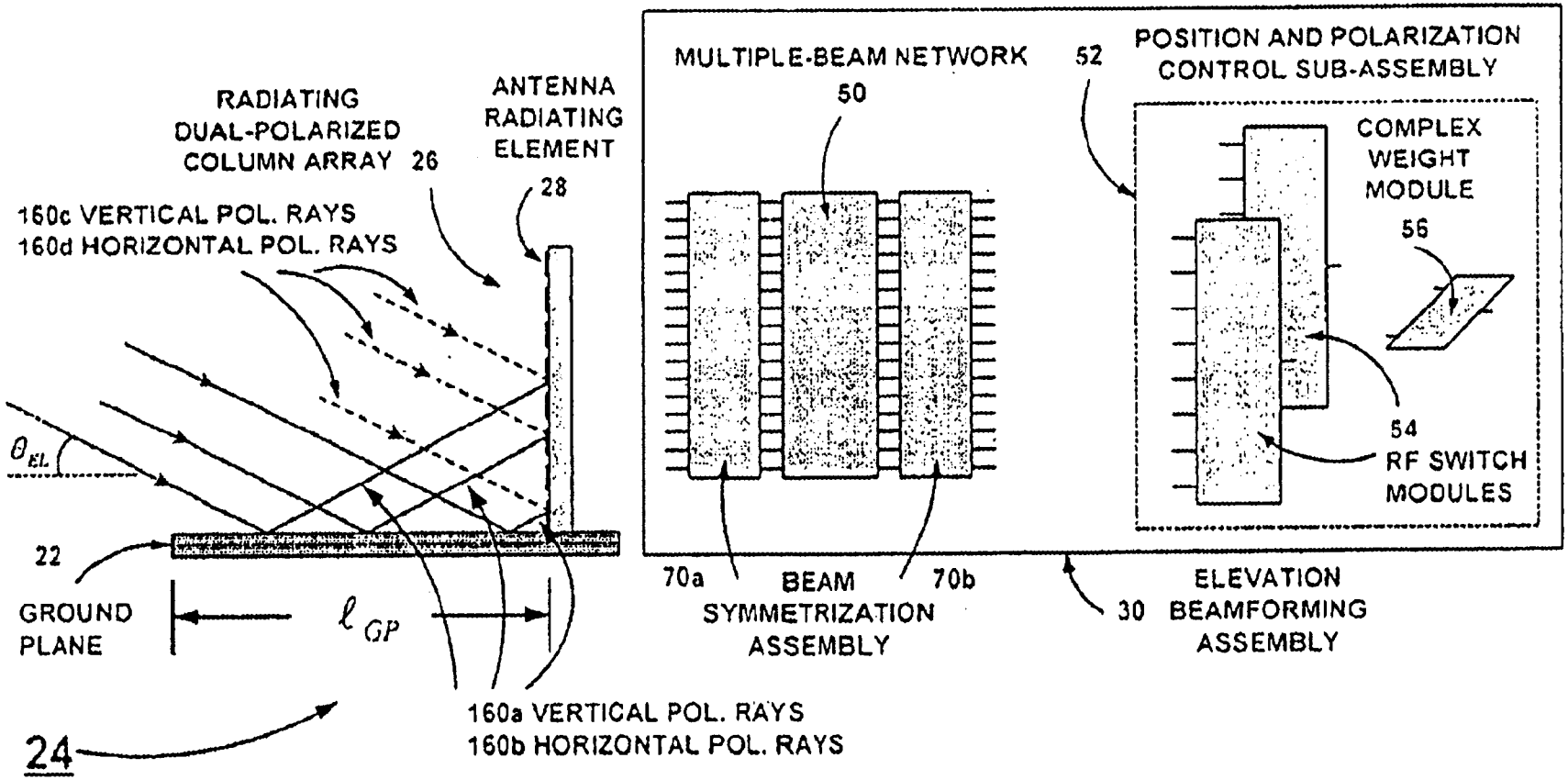
FIG. 2 is a schematic diagram describing an antenna segment as in FIG. 1, having an elevation beamforming assembly that includes a multiple-beam network.

FIG. 2 is a schematic diagram describing an antenna segment 24 whose elevation beamforming assembly 30 includes a multiple-beam microwave network 50. Each multiple-beam network 50 is a symmetric-input/co-phased output N×N multi-port microwave device that focuses a received input signal vector characterized by a linear phase gradient across its element ports 80 onto a single output port 82, or in-between two adjacent output ports (see FIG. 3). Multiple-beam network 50 is preferably implemented as a symmetric-input/co-phased output Butler matrix (BUT61), or alternatively, as a linear-array microwave lens of the Ruze (RUZ50) or Rotman (ROT61) type.

Figure 3:
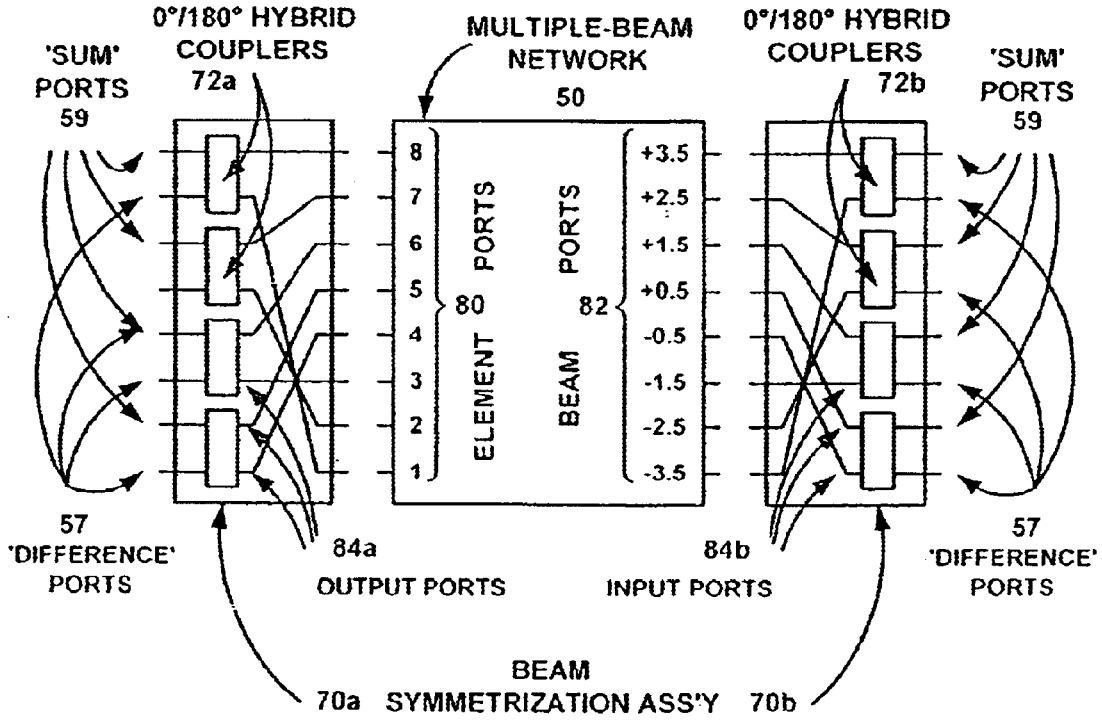
FIG. 3 is a schematic diagram that describes the allocation of multiple-beam network ports as element ports and as beam ports, and further displays the contents of beam symmetrization assemblies and their connection to the multiple-beam network.

Multiple-beam network 50 is symmetrically fed via a pair of beam symmetrization assemblies 70*a* and 70*b*. As shown in FIG. 3, each of beam symmetrization assemblies 70*a* and 70*b* includes a respective set of 0°/180° hybrid couplers 72*a* and 72*b*. Also shown in FIG. 3 is the allocation of microwave multiple-beam network 50 ports as 'element ports' 80 and as 'beam ports' 82. The indices of the element ports 80 refer to corresponding radiating elements 28 belonging to linear column array 26 of antenna segment 24. The half-integer indices of beam ports 82 refer to phase-mode numbers of a symmetric-input/co-phased output Butler matrix. Thus, in a symmetric-input/co-phased output N×N Butler matrix with N even, a beam port indexed in FIG. 3 as $0.5\cdot(2m+1)$, m=0, 1, . . . ,(N−2)/2, will apply electrical phasing of $(2m+1)\cdot(\pi/N)\cdot[n-(N+1)/2]$ on the n'th element port, where n=1, 2, . . . , N.

In addition, as shown in FIG. 2, elevation beamforming assembly 30 includes a position and polarization control subassembly 52. Subassembly 52 typically includes either a single RF switch module 54 or a pair of RF switch modules 54, as well as a complex weighting module 56. Multiple-beam network 50, in conjunction with pair of beam symmetrization assemblies 70*a*, 70*b*, form the basis for the coherent ray-imaging, elevation beam-steering and polarization control capability of each antenna segment 24.

Figure 4:
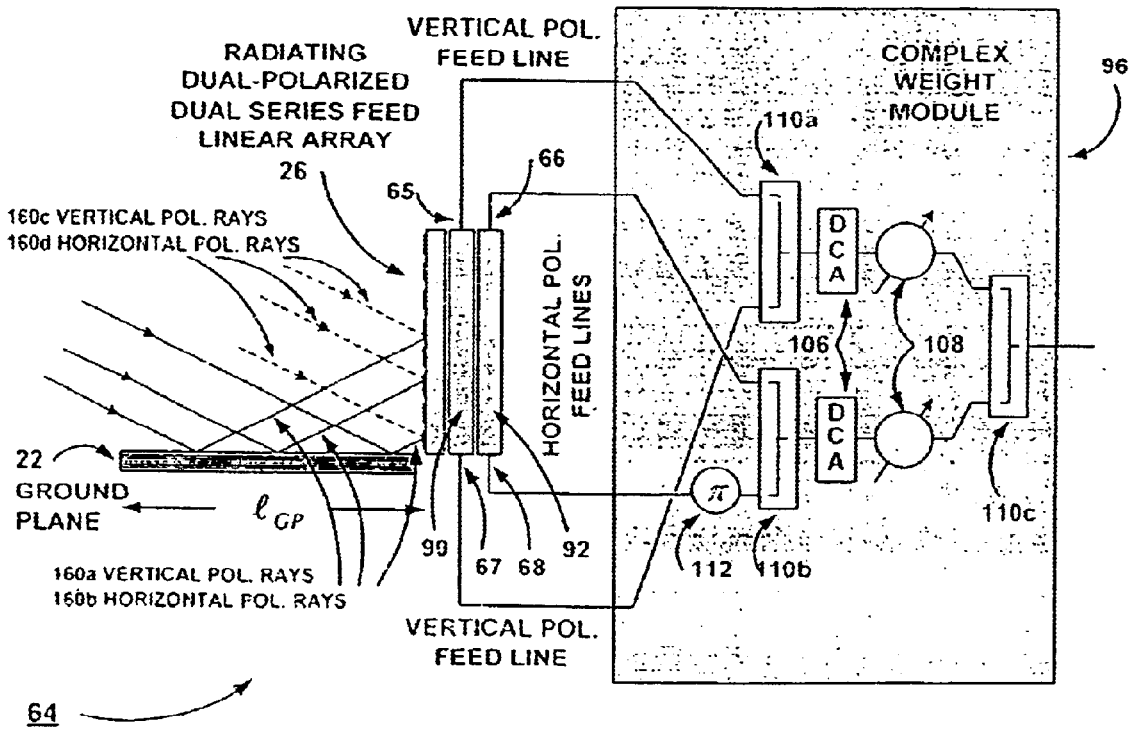
FIG. 4 is a schematic diagram illustrating an antenna segment as in FIG. 1, having an elevation beamforming assembly that includes a pair of double-ended series feed networks.

An alternative antenna segment 64 is schematically illustrated in FIG. 4. In alternative segment 64, elevation beam forming and steering is achieved using a double-ended series-feed network 90 or a leaky-wave structure 92 (or a plurality thereof) that serially feeds each linear column array 26 from both ends. Elevation beam steering can be realized via the control of frequency (frequency scan, as described for example in Begovich, N. A. in R. C. Hansen (ed.), Microwave Scanning Antennas, Vol. III, Academic Press Inc., New York, 1966, Chapter 2), voltage control of the propagation constant (in ferroelectric structures as described for example by Sengupta, L. C. et al: 'Novel Ferroelectric materials for phased array antennas', IEEE Transactions on Ultrasonics, Ferroelectrics and Frequency Control, Vol. 44, No. 4, July 1997, pp. 792–797), current control of the propagation constant (in ferromagnetic structures as described for example by Cherepanov, A. S. et al: 'Innovative integrated ferrite phased array technologies for EHF radar communication applications', IEEE International Symposium on Phased Array Systems and Technology, 1996, pp. 74–77), or by the periodic spatial modulation of the propagation constant (optically or electrically induced electron-hole plasma grating, as described in IEEE Transactions on Microwave Theory and Techniques, Vol. 45, No. 8, August 1997). Also included in this version is a complex weighting module, of which one RF implementation 96 is schematically described in FIG. 4.

In RF implementation 96 of the complex weight module, use is made of two digitally controlled attenuators (DCAs) 106, two digitally-controlled phase-shifters 108 and three two-way power combiners 110*a, b, c*. Also included is a 180° phase shifter 112.

In antenna segment 24, each horizontal-polarization feed line of array elements 28 is bridged to a respective 'difference' port 57 (FIG. 3) of the corresponding 0°/180° hybrid coupler 72*a* belonging to beam symmetrization assembly 70*a*, whereas each vertical-polarization feed line of array element 28 is bridged to a respective 'sum' port 59 of the corresponding 0°/180° hybrid coupler 72*a*, belonging to beam symmetrization assembly 70*a*. Output ports 84*a* of 0°/180° hybrid coupler 72*a* are symmetrically connected to element ports 80 of multiple-beam network 50.

Beam ports 82 of multiple-beam network 50 are symmetrically connected to input ports 84*b* of a set of 0°/180° hybrid coupler 72*b* belonging to beam symmetrization assembly 70*b*. 'Difference' ports 57 and 'sum' ports 59 of array of hybrid couplers 72*b* (FIG. 3) are bridged to position and polarization control subassembly 52 (FIG. 2) that serves as beam selector and interpolator in elevation, as beam positioner in azimuth, and as polarization controller.

Figure 5:
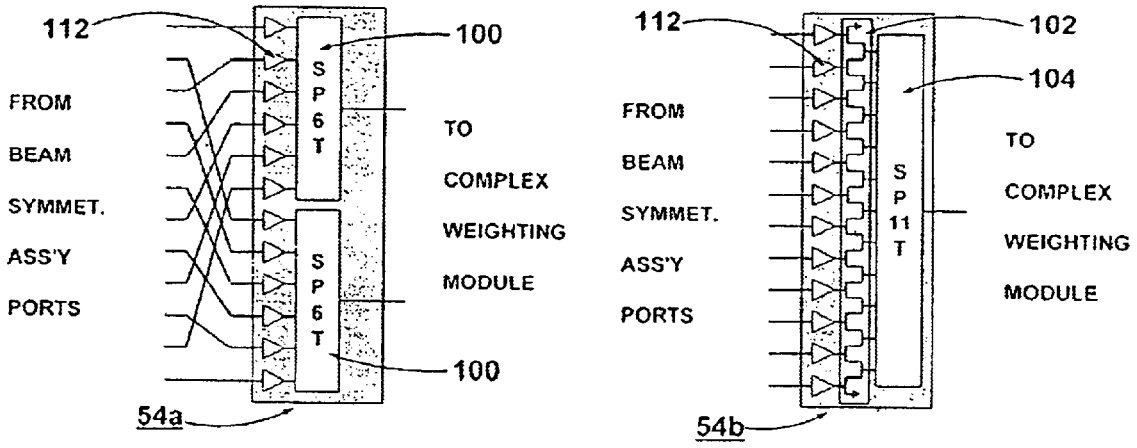
FIG. 5 is a block diagram that schematically describes two implementations for an RF switch module within the position and polarization control subassembly.

RF switch module 54 may be implemented in several ways, as schematically exemplified by implementations 54*a* and 54*b* in FIG. 5. Implementation 54*a* uses two switching units 100 that respectively connect to ports (exclusively 'difference' ports 57, or 'sum' ports 59) in odd-numbered and even-numbered 0°/180° hybrid couplers 72*b* belonging to beam symmetrization assembly 70*b* (FIG. 3). For an SPNT RF switch module, this allows the selection of N primary lens beams together with (N−1) intermediate beams, interpolated between adjacent collector port beams, thus reducing beam intersection losses in elevation, and improving sidelobe level performance in elevation. An alternative approach for the formation of interpolated beams with reduced sidelobe level in elevation is illustrated in version 54*b* of the switch module (FIG. 5), where beam interpolation is realized with the aid of a passive conversion matrix 102 and a single switch unit 104 within the switch module. Here, only interpolated beams are available.

Figure 6:
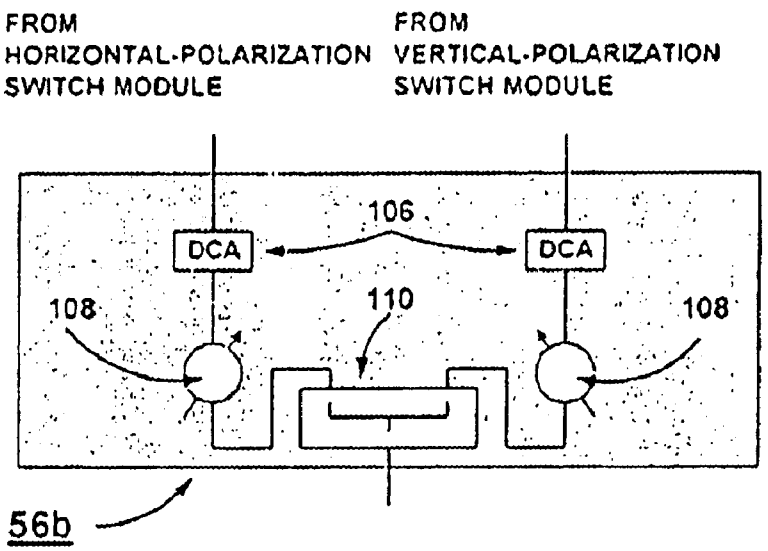
FIG. 6 is a block diagram that schematically describes two implementations of a complex weighting module within the position and polarization control subassembly.
Figure 6:
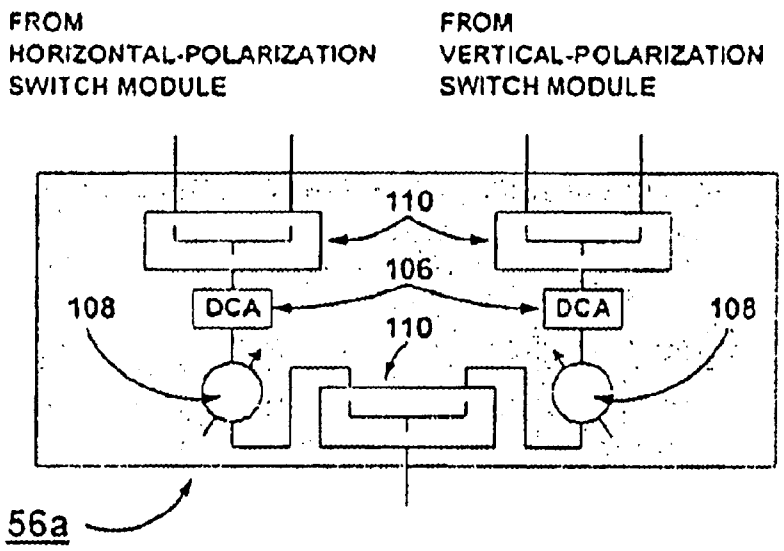

The output ports of the RF switch modules 54 (a pair of output ports in implementation 54*a*, a single output port in implementation 54*b* of FIG. 5) are connected, as illustrated in FIG. 5, to complex weighting module 56 (*a* or *b*, see also FIG. 2) that applies controlled attenuation and phasing on the input lines, as well as acting as an RF power combiner. As shown in FIG. 6, complex weighting module 56 may have various implementations, for example implementations 56*a* and 56*b* that correspond to implementations 54*a* and 54*b* for switch module 54. In the above two possible RF implementations of module 56, use is made of two digitally controlled attenuators (DCAs) 106, two digitally-controlled phase-shifters 108 and up to three two-way power combiners 110.

Complex weighting modules 56 and 96 are the key to the following antenna features:

a) Attenuation control for beam interpolation, linear polarization agility and calibration.

b) Phase control for azimuth beam steering, circular polarization agility and calibration.

Each antenna segment 24 may be configured as a passive (non-amplified) module, or alternatively in a variety of amplified architectures. These include:

a) Receiving aperture-active (low-noise amplified per array element) module.

b) Receiving beam-active (low-noise amplified per lens beam) module.

c) Transmitting aperture-active (power-amplified per array element) module.

d) Transmitting beam-active (power-amplified per lens beam) module.

e) Duplexed or T/R-switched transmitting and receiving active module (aperture-active, beam-active or polarization-active)

For example, the use of low-noise amplifiers 112 at the input ports of switch units 54*a* or 54*b* (FIG. 5) supports architecture "b" above.

The ray imaging concept of the present invention is applicable to a planar antenna array mounted on an electrically conductive ground plane, and designed either for one-dimensional (1D-elevation) or two-dimensional (2D-elevation and azimuth) electronic beam steering.

Figure 7:
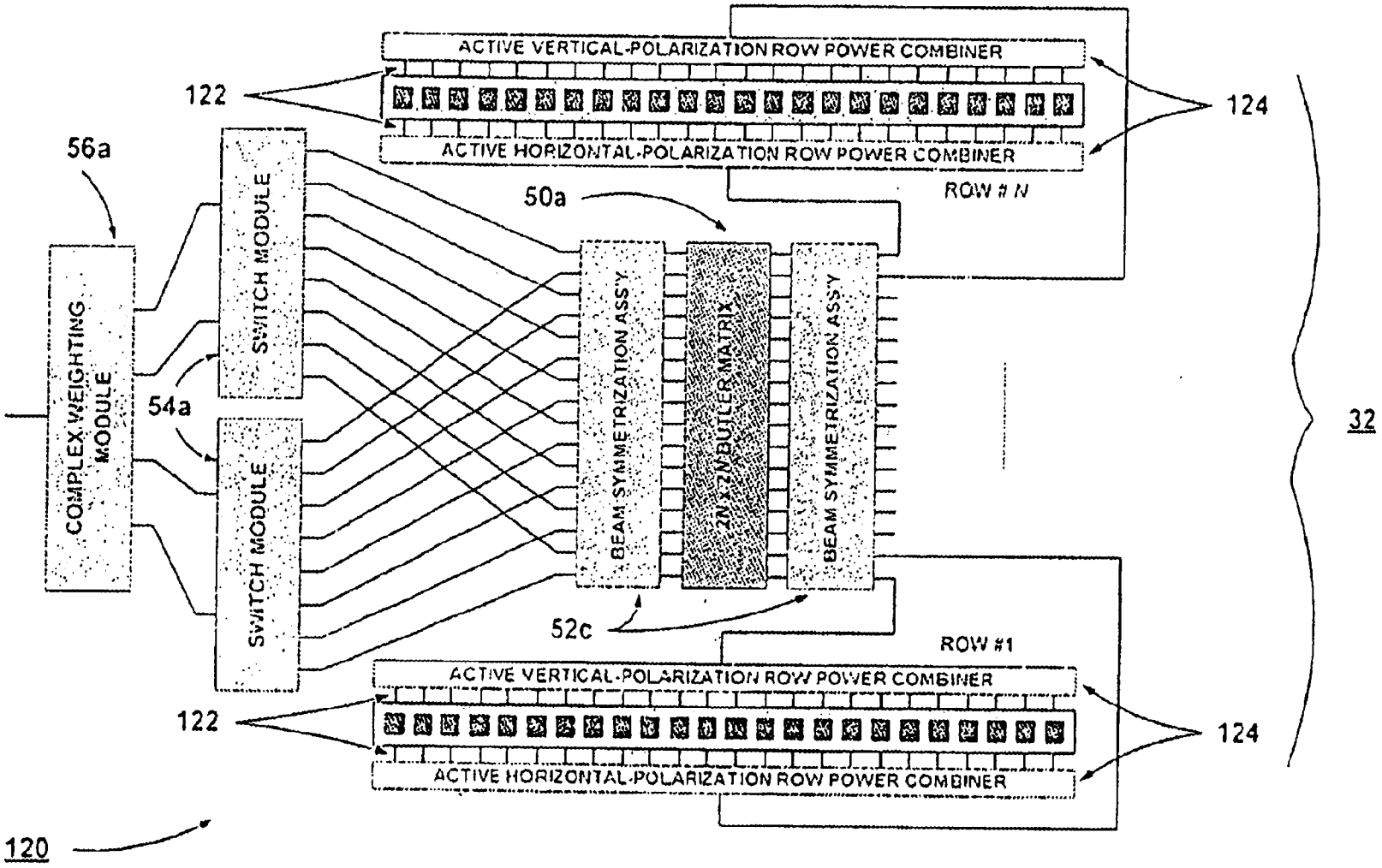
FIG. 7 is a block diagram that schematically describes the architecture of an antenna unit that may be electronically steered in elevation only.

FIG. 7 schematically depicts a possible antenna architecture for an antenna 20 unit 120 designed for 1D electronic beam steering. Here, radiating array 32 of antenna unit 120 is partitioned into rows 1 to N. Horizontal-polarization and vertical-polarization feed lines 122 from the radiating elements in each row of planar array 32 are separately combined in row power combiners 124 to a pair of output lines, one for each polarization. These pairs of output lines from each array row are bridged to the appropriate lens element ports 80 of single elevation beamforming assembly 30 (FIG. 4).

Figure 8:
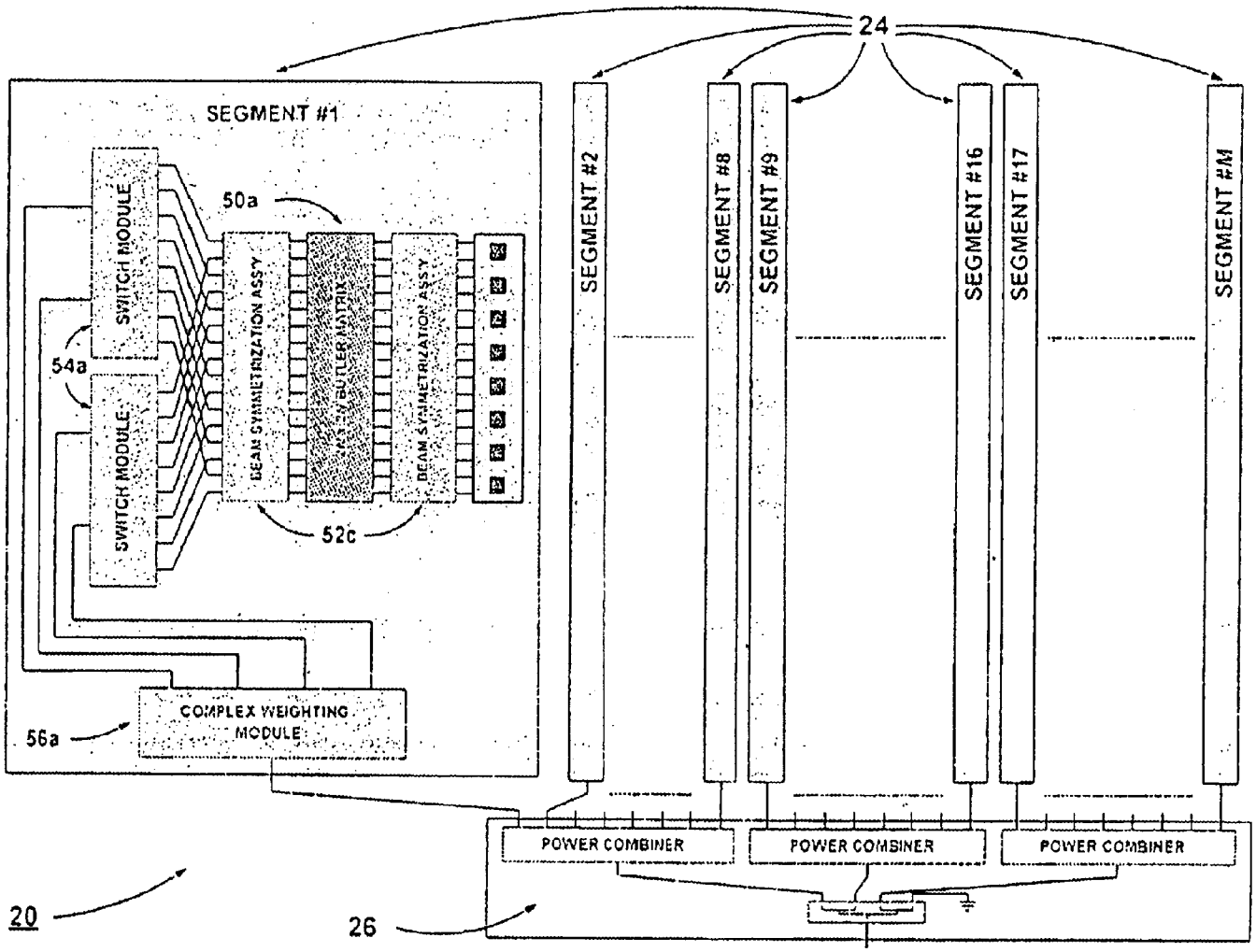
FIG. 8 is a block diagram schematically describing the architecture of an antenna unit that may be electronically steered in elevation and in azimuth.

FIG. 8 schematically depicts a possible architecture for an antenna sub-unit 20 designed for 2D electronic beam steering. Here, a number of antenna segments 24 (labeled #1 to #M) are linearly stacked together in azimuth, and their outputs combined in power combiner 26. An antenna 140 comprising three to four selectable sub-units 20 will be able to provide full 360°-azimuth coverage.

Electrically conductive plane 22 forms an integral part of each antenna sub-unit 20 in that electric currents on plane 22 represent a mirror image of the antenna sub-unit, enhancing the effective area of the physical antenna sub-unit above the plane. The required dimensions of electrically conductive plane 22 depend on the height H of cylindrical radiating array 32 (FIGS. 1, 2), and on the lowest sought elevation coverage angle $\theta_{EL\ min}$ from the (possibly tilted) ground plane 22. When antenna sub-units 20 are mounted on top of a large airborne platform such as a passenger airplane, as shown in FIG. 9, external imaging plates 150 must also be installed in juxtaposition to the antenna as extensions to electrically conductive planes 22.

Figure 9:
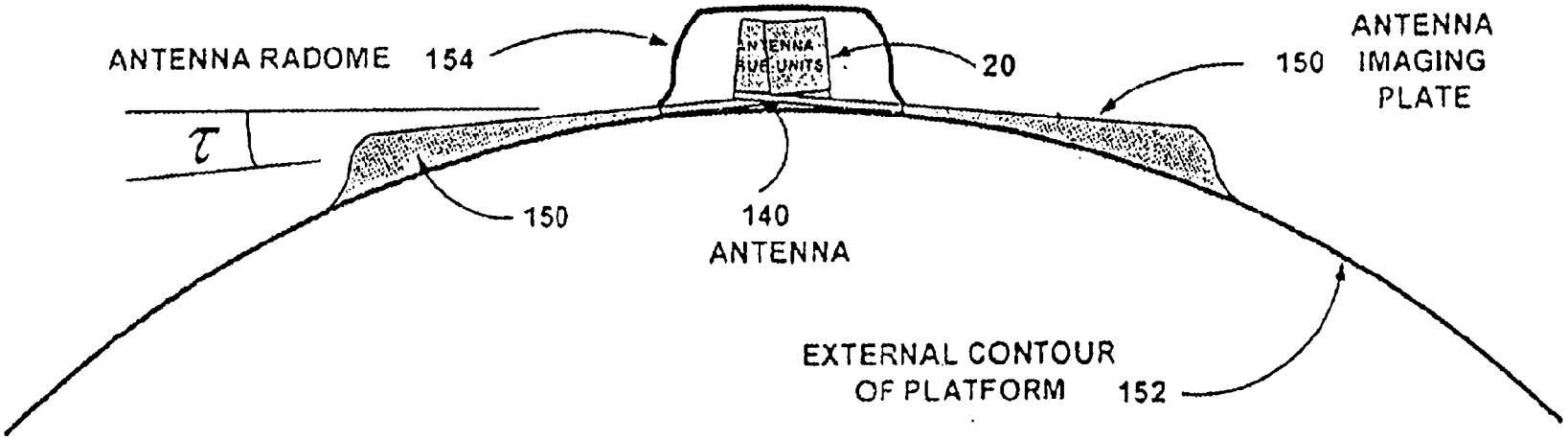
FIG. 9 is a schematic diagram that describes the use of imaging plates externally fitted on an airplane fuselage, in juxtaposition to a top-mounted ray imaging antenna.

FIG. 9 is a schematic diagram that describes the use of imaging plates 150 externally fitted on an airplane fuselage contour or platform 152, in juxtaposition to a top-mounted ray imaging antenna 140, comprising several antenna sub-units 20, and shown here with an antenna radome 154. External imaging plates 150 must provide an extended ground plane of adequate extent and a predetermined tilt angle, commensurate with a similar tilt of antenna sub-units 20, which reduces the minimum elevation coverage angle $\theta_{EL\ min}$ without resorting to an oversized extended ground plane. If a minimum elevation coverage angle of $\theta_{EL\ min}$ above the horizon is sought, and $\tau$ is the tilt angle of the ground plane (FIG. 10), the required extent $l_{GP}$ (FIG. 2) of the ground plane from the array 32 is given by:

$$l_{GP} \geq \frac{H}{\tan(\theta_{EL\min} + \tau)}$$

Principle of Operation

On "receive", a planar wave-front impinging on antenna segment 24 and electrically conductive ground plane 22 at some angle $\theta_{EL}$ above the ground plane (see FIG. 2), will be received by the elements of planar array 32 (FIG. 1) as the respective sum and difference for vertically polarized and horizontally polarized plane waves, of incident contributions from $+\theta_{EL}$ and $-\theta_{EL}$ above the ground plane. Four contributions should be considered (FIG. 2).

Vertical-polarization rays 160*a* emanating from the externally reflected plane-wave field component, incident at $-\theta_{EL}$. This component, which does not suffer an extra 180° phase shift, is directed to 'sum' ports 59 of 0°/180° hybrid couplers 72*a* belonging to beam symmetrization assembly 70*a*, directing a pair of co-phased signals towards pair of symmetric beam ports 82 of multiple-beam network 50. The signals delivered to these beam ports are then combined by a 0°/180° hybrid coupler 72*b* belonging to beam symmetrization assembly 70*b* that will direct the combined signal to its 'sum'port 59.

Horizontal-polarization rays 160*b* emanating from the externally reflected plane-wave field component, incident at $-\theta_{EL}$ This component, which suffers an extra 180° phase shift, is directed to 'difference' ports 57 of 0°/180° hybrid couplers 72*a* belonging to beam symmetrization assembly 70*a*, directing a pair of anti-phased signals towards pair of symmetric beam ports 82 of multiple-beam network 50. The signals delivered to these beam ports are then combined by a 0°/180° hybrid coupler 72*b* belonging to beam symmetrization assembly 70*b* that will direct the combined signal to its 'difference' port 57.

Vertical-polarization rays 160*c* emanating from the direct external plane-wave field component incident at $+\theta_{EL}$. This direct component is directed to 'sum' ports 59 of 0°/180° hybrid couplers 72*a* belonging to beam symmetrization assembly 70*a*, directing a pair of co-phased signals towards pair of symmetric beam ports 82 of multiple-beam network 50. The signals delivered to these beam ports are then combined by a 0°/180° hybrid coupler 72*b* belonging to beam symmetrization assembly 70*b* that will direct the combined signal to its 'sum' port 59.

Horizontal-polarization rays 160*d* emanating from the direct external plane-wave field component incident at $+\theta_{EL}$. This direct component is directed to 'difference' ports 57 of element-port 0°/180° hybrid couplers 72*a* belonging to beam symmetrization assembly 70*a*, directing a pair of anti-phased internal signals towards pair of symmetric beam ports 82 of multiple-beam network 50. The signals delivered to these beam ports are then combined by a 0°/180° hybrid coupler 72*b* belonging to beam symmetrization assembly 70*b* that will direct the combined signal to its 'difference' port 57.

Both vertical-polarization components (direct and externally reflected) generate co-phased contributions in the two beam ports of multiple-beam network 50, and are therefore coherently combined at the 'sum' output of the appropriate beam-port 0°/180° hybrid coupler unit 72*b*. In contrast, the horizontal-polarization components always generate anti-phased contributions in the two beam ports of multiple-beam network 50, and are therefore coherently combined at the 'difference output of the appropriate beam-port 0°/180° hybrid coupler unit 72*b*. Although the externally reflected horizontal-polarization component suffers an extra 180° phase-shift, this is compensated by an additional anti-phasing introduced by the seemingly opposite directions of incidence ($-\theta_{EL}$ and $+\theta_{EL}$)

'Difference' ports 57 and 'sum' ports 59 of 0°/180° hybrid couplers 72*b* belonging to beam symmetrization assembly 70*b* are selectable by switch modules 54*a* or 54*b*. Phase-shifters 108 (FIG. 6) within complex weighting module 56*a* or 56*b* may be used to compensate for the extra 180° phase shift, as well as for the introduction of additional phase-shifts for the reception/transmission of circular polarization, for beam steering in azimuth, and for the correction of phase errors. DCAs 106 within complex weighting module 56*a* or 56*b* (FIG. 6) provide the means to receive or transmit slant linear or elliptical polarization, and to correct for amplitude errors.

Four contributions should also be considered when a planar wave-front is incident at angle $\theta_{EL}$ on antenna segment 64 lying on electrically conductive ground plane 22 (FIG. 4):

Vertical-polarization rays 160*a* emanating from the externally reflected plane-wave field component, incident at $-\theta_{EL}$. This component, which does not suffer an extra 180° phase shift, is directed to the top-end series-feed port 65 and thence to power combiner 110*a* within complex weight module 96.

Horizontal-polarization rays 160*b* emanating from the externally reflected plane-wave field component, incident at $-\theta_{EL}$. This component, which suffers an extra 180° phase shift, is directed to top-end series-feed port 66 and thence to power combiner 110*b* within complex weight module 96.

Vertical-polarization rays 160*c* emanating from the direct external plane-wave field component incident at $+\theta_{EL}$. This direct component is directed to bottom-end series-feed port 67 and thence to power combiner 110*a* within complex weight module 96.

Horizontal-polarization rays 160*d* emanating from the direct external plane-wave field component incident at $+\theta_{EL}$. This direct component is directed to bottom-end series-feed port 68 and thence to power combiner 110*b* within complex weight module 96.

In antenna segment 64, vertical-polarization and horizontal-polarization components are coherently added by power combiners 110*a* and 110*b*, respectively. Power combiner 110*c* in conjunction with DCA units 106 and phase-shifters 108, generate an output signal of the desired polarization. Elevation beam steering is implemented externally by change of frequency or control of the propagation constant in series feed networks 90, 92.

Although the principle of operation was discussed for a receiving antenna unit, it equally applies for a transmitting unit.

All publications, patents and patent applications mentioned in this application are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described with respect to a limited number of embodiments, it will be appreciated that many variations, modifications and other applications of the invention may be made.

What is claimed is:

1. A ray-imaging, electronic beam-steering antenna comprising:

a. at least one antenna segment, each said at least one antenna segment having at least one output and including a plurality of horizontally-polarized radiating column-array elements and an elevation beam-forming assembly, said plurality of radiating column-array elements disposed adjacently on a common line, and b. an electrically conductive ground reflector plane positioned perpendicular to said common line, said ground reflector plane allowing gain-enhanced, horizontal-polarization beam generation and steering in planes perpendicular to said ground reflector plane;

wherein said elevation beam-forming assembly includes i. a microwave multiple-beam network having a first plurality of element ports and a second plurality of beam ports, ii. a set of two-way power dividers, each of said set having a pair of output ports, and incorporating an 180° phase shift between two ports of said pair of output ports, iii. a set of two-way power combiners, each of said set having a pair of input ports, and incorporating an 180° phase shift between two ports of said pair of input ports, and iv. a beam selection switching module connected to said set of power combiners.

2. The antenna of claim 1, wherein said microwave multiple-beam network includes a Butler type matrix.

3. The antenna of claim 2, wherein said Butler-type matrix is selected from the group consisting of stripline printed circuit microwave matrices and microstrip printed circuit microwave matrices.

4. The antenna of claim 1, wherein said microwave multiple-beam network includes a microwave lens selected from the group consisting of a Ruze-type lens and a Rotman type microwave lens.

5. The antenna of claim 1, comprising a plurality of said antenna segments, and further comprising a power combiner connected electrically to said at least one output of each of at least two of said antenna segments.

6. The antenna of claim 5, wherein said power combiner is selected from the group consisting of a conventional power combiner, a power combiner having phase shifters, a power combiner having delay phase shifters, a Ruze-type lens, a Rotman-type lens, and any combination thereof.

7. The antenna of claim 1, wherein said beam selection switching module includes a single-pole switching module that incorporates a passive beam conversion matrix.

8. The antenna of claim 1, wherein said beam selector switching module includes a two-pole switching module, whereby said two-pole switching module allows both single pole selection and dual pole selection.

9. The antenna of claim 1, wherein said elevation beam-forming assembly includes a double ended series feed network or leaky wave structure and a two-way power combiner with a pair of input ports, said power combiner incorporating a 1800 phase shift at one of its input ports.

10. The antenna of claim 9, wherein said feed network includes a mechanism for controlling said electronic elevation steering of the antenna beam selected from the group consisting of frequency control, propagation constant control, periodic spatial modulation of said propagation constant, and any combination thereof.

11. A ray-imaging, electronic beam-steering antenna comprising:

a. at least one antenna segment, each said at least one antenna segment having at least one output and including a plurality of vertically-polarized radiating column-array elements and an elevation beam-forming assembly, said plurality of radiating column-array elements disposed adjacently on a common line, and b. an electrically conductive ground reflector plane positioned perpendicular to said common line, said ground reflector plane allowing gain-enhanced, vertical-polarization beam generation and steering in planes perpendicular to said ground reflector plane;

wherein said elevation beam-forming assembly includes:

i. a microwave multiple-beam network having a first plurality of element ports and a second plurality of beam ports, ii. a set of two-way power dividers, each of said set of power dividers having a pair of output ports, iii. a set of two-way power combiners, each of said set of power combiners having a pair of input ports, and iv. a beam selection switching module connected to said set of power combiners.

12. The antenna of claim 11, wherein said microwave multiple-beam network is a Butler type matrix.

13. The antenna of claim 12, wherein said Butler-type matrix is selected from the group consisting of stripline printed circuit microwave matrices and microstrip printed circuit microwave matrices.

14. The antenna of claim 11, wherein said microwave multiple-beam network includes a microwave lens selected from the group consisting of a Ruze-type lens and a Rotman type microwave lens.

15. The antenna of claim 11, wherein said beam selector switching module includes a single-pole switching module that incorporates a passive beam conversion matrix.

16. The antenna of claim 11, wherein said beam selector switching module includes a two-pole switch module, whereby said two-pole switch module allows both single pole selection and dual pole selection.

17. The antenna of claim 11, comprising a plurality of said antenna segments, and further comprising a power combiner connected electrically to said at least one output of each of at least two of said antenna segments.

18. The antenna of claim 17, wherein said power combiner is selected from the group consisting of a conventional power combiner, a power combiner having phase shifters, a power combiner having delay phase shifters, a Ruze-type lens, a Rotman-type lens, and any combination thereof.

19. The antenna of claim 11, wherein said elevation beam-forming assembly includes a double ended series feed network or leaky wave structure and a two-way power combiner.

20. The antenna of claim 19, wherein said feed network includes a mechanism for controlling said electronic elevation steering of the antenna beam selected from the group consisting of frequency control, propagation constant control, periodic spatial modulation of said propagation constant, and any combination thereof.

21. A ray-imaging, electronic beam-steering antenna comprising:

a. at least one antenna segment, each said at least one antenna segment having at least one output and including a plurality of dual-polarized radiating column-array elements and an elevation beam-forming assembly, said plurality of radiating arc elements disposed adjacently on a common line, and b. an electrically conductive ground reflector plane positioned perpendicular to said common line, said ground reflector plane allowing, for any polarization, gain-enhanced, beam generation and steering in planes perpendicular to said ground reflector plane;

wherein said elevation beam-forming assembly includes i. a microwave multiple-beam network having a first plurality of element ports and a second plurality of beam ports, ii. a set of 180° hybrid couplers, each of said set having a sum port and a difference port, said hybrid couplers symmetrically feeding said element ports and beam ports of said multiple-beam network, and iii. a pair of beam selection switching modules connected respectively to said sum and said difference ports of a sub-set of said 180° hybrid couplers feeding said beam ports of said multiple beam network.

22. The antenna of claim 21, wherein said elevation beam-forming assembly further includes a complex weighting module connected to said pair of beam selector switching modules.

23. The antenna of claim 21, wherein said microwave multiple-beam network includes a Butler type matrix.

24. The antenna of claim 23, wherein said Butler-type matrix is selected from the group consisting of stripline printed circuit microwave matrices and microstrip printed circuit microwave matrices.

25. The antenna of claim 21, wherein said microwave multiple-beam network includes a microwave lens selected from the group consisting of a Ruze-type lens and a Rotman type microwave lens.

26. The antenna of claim 21, comprising a plurality of said antenna segments, and further comprising at least one power combiner connected electrically to said at least one output of each of at least two of said antenna segments.

27. The antenna of claim 26, wherein said power combiner is selected from the group consisting of a conventional power combiner, a power combiner having phase shifters, a power combiner having delay phase shifters, a Ruze-type lens, a Rotman-type lens, and any combination thereof.

28. The antenna of claim 21, wherein each of said pair of beam selector switching modules includes a single-pole switching module that incorporates a passive beam conversion matrix.

29. The antenna of claim 21, wherein each of said pair of beam selector switching modules includes a two-pole switch module, whereby said two-pole switch module allows both single pole selection and dual pole selection.

30. The antenna of claim 21, wherein said elevation beam-forming assembly includes a pair of double ended series feed networks having a plurality of output ports, and a complex weight module, connected to said output ports of said pair of feed networks.

31. The antenna of claim 30, wherein each said feed network includes a mechanism for controlling said electronic elevation steering of the antenna beam selected from the group consisting of frequency control, propagation constant control, periodic spatial modulation of said propagation constant, and any combination thereof.

32. A ray-imaging, electronic beam-steering antenna comprising:

a. a plurality of antenna segments, each said antenna segment having at least one output and including a plurality of horizontally-polarized radiating column-array elements and an elevation beam-forming assembly, said plurality of radiating column-array elements disposed adjacently on a common line, b. an electrically conductive ground reflector plane positioned perpendicular to said common line, said ground reflector plane allowing gain-enhanced, horizontal-polarization beam generation and steering in planes perpendicular to said ground reflector plane, and c. a power combiner connected electrically to said at least one output of each of at least two of said antenna segments.

33. A ray-imaging, electronic beam-steering antenna comprising:

a. a plurality of antenna segments, each said antenna segment having at least one output and including a plurality of vertically-polarized radiating column-array elements and an elevation beam-forming assembly, said plurality of radiating column-array elements disposed adjacently on a common line, b. an electrically conductive ground reflector plane positioned perpendicular to said common line, said ground reflector plane allowing gain-enhanced, vertical-polarization beam generation and steering in planes perpendicular to said ground reflector plane; and c. a power combiner connected electrically to said at least one output of each of at least two of said antenna segments.

34. A ray-imaging, electronic beam-steering antenna comprising:

a. a plurality of antenna segments, each said antenna segment having at least one output and including a plurality of dual-polarized radiating column-array elements and an elevation beam-forming assembly, said plurality of radiating arc elements disposed adjacently on a common line, b. an electrically conductive ground reflector plane positioned perpendicular to said common line, said ground reflector plane allowing, for any polarization, gain-enhanced, beam generation and steering in planes perpendicular to said ground reflector plane, and c. at least one power combiner connected electrically to said at least one output of each of at least two of said antenna segments.

35. A ray-imaging, electronic beam-steering antenna comprising:

a. at least one antenna segment, each said at least one antenna segment having at least one output and including a plurality of horizontally-polarized radiating column-array elements and an elevation beam-forming assembly, said plurality of radiating column-array elements disposed adjacently on a common line, and b. an electrically conductive ground reflector plane positioned perpendicular to said common line, said ground reflector plane allowing gain-enhanced, horizontal-polarization beam generation and steering in planes perpendicular to said ground reflector plane, wherein said elevation beam-forming assembly includes a double ended series feed network or leaky wave structure and a two-way power combiner with a pair of input ports, said power combiner incorporating a 180° phase shift at one of its input ports.

36. A ray-imaging, electronic beam-steering antenna comprising:

a. at least one antenna segment, each said at least one antenna segment having at least one output and including a plurality of vertically-polarized radiating column-array elements and an elevation beam-forming assembly, said plurality of radiating column-array elements disposed adjacently on a common line, and b. an electrically conductive ground reflector plane positioned perpendicular to said common line, said ground reflector plane allowing gain-enhanced, vertical-polarization beam generation and steering in planes perpendicular to said ground reflector plane, wherein said elevation beam-forming assembly includes a double ended series feed network or leaky wave structure and a two-way power combiner.

37. A ray-imaging, electronic beam-steering antenna comprising:

a. at least one antenna segment, each said at least one antenna segment having at least one output and including a plurality of dual-polarized radiating column-array elements and an elevation beam-forming assembly, said plurality of radiating arc elements disposed adjacently on a common line, and b. an electrically conductive ground reflector plane positioned perpendicular to said common line, said ground reflector plane allowing, for any polarization, gain-enhanced, beam generation and steering in planes perpendicular to said ground reflector plane, wherein said elevation beam-forming assembly includes a pair of double ended series feed networks having a plurality of output ports, and a complex weight module, connected to said output ports of said pair of feed networks.

* * * * *

UNITED STATES PATENT AND TRADEMARK OFFICE

CERTIFICATE OF CORRECTION

PATENT NO. : 6,680,698 B2
DATED : January 20, 2004
INVENTOR(S) : Eiges

It is certified that error appears in the above-identified patent and that said Letters Patent is hereby corrected as shown below:

Column 12,
Line 40, “1800” should read -- 180º --

Column 13,
Line 56 and 62, “180º” should read -- 0/180º --

Signed and Sealed this

Twenty-first Day of September, 2004

JON W. DUDAS
*Director of the United States Patent and Trademark Office*